United States Patent [19]

Heiman et al.

[11] 3,966,034

[45] June 29, 1976

[54] PHASE SENSITIVE COIN DISCRIMINATION METHOD AND APPARATUS

[75] Inventors: Fred P. Heiman, Delran, N.J.; Guustaaf Arthur Schwippert, Pijnacker, Netherlands

[73] Assignee: Mars, Inc., McLean, Va.

[22] Filed: Oct. 12, 1973

[21] Appl. No.: 405,928

[30] Foreign Application Priority Data

Oct. 12, 1972 United Kingdom ..... 47163/72

[52] U.S. Cl. ..... 194/100 A

[51] Int. Cl.[2] ..... G07F 3/02

[58] Field of Search ..... 194/100 A, 100 R, 97 R; 209/81 R, 81 A; 73/163; 324/41

[56] References Cited

UNITED STATES PATENTS

| | | | |
|---|---|---|---|
| 3,561,580 | 2/1971 | Meloni | 194/100 A |
| 3,738,468 | 6/1973 | Prumm | 194/100 A |
| 3,837,454 | 9/1974 | Joeck | 194/100 A X |

FOREIGN PATENTS OR APPLICATIONS

| | | | |
|---|---|---|---|
| 2,001,962 | 10/1969 | France | 194/100 A |
| 2,090,353 | 5/1971 | France | 194/100 A |

*Primary Examiner*—Stanley H. Tollberg
*Assistant Examiner*—Joseph J. Rolla
*Attorney, Agent, or Firm*—Davis, Hoxie, Faithfull & Hapgood

[57] ABSTRACT

A phase sensitive method and apparatus for general use in coin discrimination are disclosed, along with embodiments having particular utility in discriminating between two different coin denominations having quite similar physical characteristics.

24 Claims, 7 Drawing Figures

PHASE SENSITIVE COIN DISCRIMINATION METHOD AND APPARATUS

We have found in discriminating between coins, tokens and the like, that the techniques previously used are not always capable of discriminating between two different coin denominations having nearly the same diameter and thickness, which are made of the same or similar materials. An example of two such coin denominations is the British five pence (5P) piece and the West German one Deutschemark (1DM) piece. Since coins of the latter denomination have a value considerably in excess of those of the former one, it is important to accurately discriminate between them whenever both denominations are likely to be encountered.

We have invented a phase sensitive method and apparatus for use as an element of a coin discrimination system which, in various embodiments, is capable of discriminating between similar coins, such as 5P and 1 DM pieces, and is useful as a general coin discriminating system.

The method of our invention comprises generating an alternating magnetic field, placing the coin to be tested with one face toward the source of the field and comparing the phases of the field adjacent the two faces of the coin. This can be accomplished practically by passing a first AC signal through a first wire thereby inducing a second AC signal in a second wire spaced from the first wire, placing a coin between the wires so as to shield direct paths from one wire to the other and comparing the phases of the two AC signals. In a variation of this method, a third wire on the same side of the coin as the first wire may be used to sense the phase of the field on that side of the coin, in which case the phase of the AC signal induced in the third wire would be compared with that of the second AC signal. The method of our invention is relatively insensitive to minor variations in wire spacing or coin spacing from the magnetic field as compared with measurements of the amplitude of a transmitted field as influenced by the presence of a coin in the field.

The figures are intended to be representational and are not necessarily drawn to scale.

Throughout this specification the term "coin" is intended to mean genuine coins, tokens, counterfeit coins, slugs, washers, and any other item which may be used by persons in an attempt to use coin-operated devices.

Figure 1:
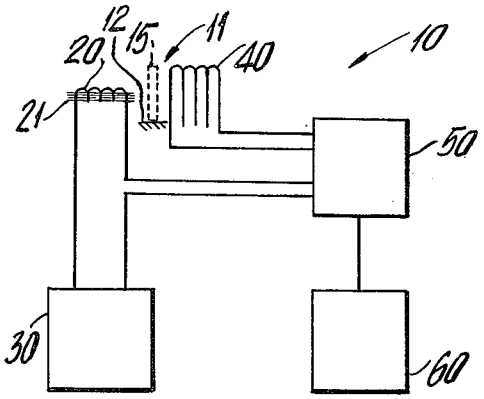
FIG. 1 is a schematic block diagram of apparatus for general coin discrimination.

Suitable apparatus 10 for the practice of our invention for general coin discrimination shown schematically in FIG. 1 includes a transmitting coil 20 of small diameter, which may be wound on a ferrite core 21, placed on the opposite side of a coin passageway 11 from a receiving coil 40. A coin track 12 is arranged at the bottom of the coin passageway 11 to permit a coin 15 to pass between the two coils. The transmitting coil 20 is connected to the output of a sine wave oscillator 30 producing a stable frequency suitable for the particular coin denominations to be distinguished. A phase comparator 50 is connected to compare the phase angle of the receiver coil 40 signal with the phase angle of the transmitter coil 20 signal. A decoder 60 is arranged to produce a signal when the peak phase angle difference is within the predetermined limits for a genuine coin of an acceptable denomination.

The use of a small diameter transmitter coil 20 tends to reduce sensitivity to coin diameter, while the use of a large number of turns in the receiver coil 40 tends to increase the output signal thereby improving the signal-to-noise ratio. Comparison of transmitter coil 20 current with the unloaded voltage across the receiver coil 40 is preferred, as it produces a more stable and temperature independent result.

Figure 2:
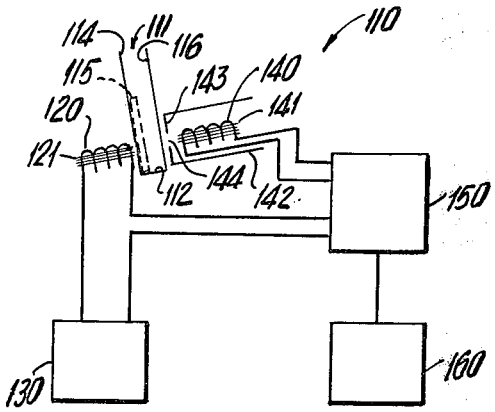
FIG. 2 is a schematic block diagram of apparatus for distinguishing between different denominations of coins having similar physical characteristics.

FIG. 2 schematically shows a coin discriminator apparatus 110 designed for distinguishing between different denominations of coins having similar physical characteristics, which we call a "similar coin discriminator". The example discussed here is particularly adapted to discrimination between the German one deutschemark (1 DM) and the British five pence (5P) coins. These coins have quite similar physical properties as indicated in the table below of nominal physical properties.

| | 1 DM | 5P |
|---|---|---|
| Diameter | 23.5 mm | 23.6 mm |
| Rim thickness | 1.75 mm | 1.73 mm |
| Interior thickness (mean) | 1.50 mm | 1.62 mm |
| Weight | 5.50 g | 5.66 g |
| Material | Cu – 75%<br>Ni – 25% | Cu – 75%<br>Ni – 25% |

Differentiation between these coin denominations by conventional techniques has not been very successful, particularly because the similarity of such coins is accentuated by the permitted manufacturing tolerances for each property and necessary allowances for wear.

In the embodiment of FIG. 2, transmitter coil 120 is a 4 mm diameter by 5 mm long coil of approximately 200 turns on a ferrite core 121, spaced approximately 2 mm from the sidewall 114 of the coin passageway 111. The coin 115 being tested is caused to bear against the sidewall 114 by an approximately 10° off vertical tilt of the sidewall 114 and a corresponding tilt of approximately 10° off horizontal of the coin track 112. Spaced approximately 5 mm from the first sidewall 114 is a parallel second sidewall 116 which forms the other side of the coin passageway 111. A receiver coil 140, similar to the transmitter coil 120, having a ferrite core 141, is spaced approximately 4 mm from the passageway surface of sidewall 116 behind a conductive shield 142. The shield 142 may be, e.g., an aluminum cylinder 10 mm in diameter having a closed end 143 adjacent the passageway 111 and a hole 144 at least 2 mm in diameter in the center of the end 143 and a slit (not shown) from the hole 144 down one side of the shield 142 to prevent the shield from being a shorted loop. The receiver coil 140 is centered within the shield 142.

The transmitter coil 120 is driven by an oscillator 130 at a frequency of 320 kHz. The phase comparator 150, which in one prototype apparatus produces a digital pulse train signal whose duty cycle is proportional to phase difference, compares the phase of the transmitter coil current with the phase of the unloaded voltage across the receiver coil 140. The signal level resulting from the phase comparison is then compared by decoder 160 with information defining the limits for genuine coins of an acceptable denomination. In the prototype apparatus, the latter comparison is accomplished by comparing the average signal level of the digital signal with reference voltages. The prototype apparatus is able to separate 100 5P coins and 200 1 DM coins into two populations by denomination with at least 99% accuracy (excepting damaged coins), with a 20° minimum phase difference separating the populations.

Figure 5:
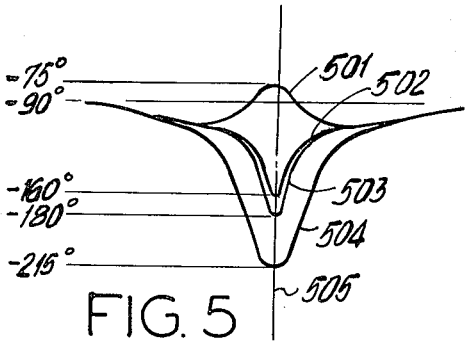
FIG. 5 is a plot of phase difference versus coin position with apparatus similar to that of FIG. 2.

FIG. 5 illustrates the phase difference obtained versus position of a coin moved slowly along the coin track 112 with respect to the coils in an apparatus similar to the apparatus 110 described above. Curves 501 and 502 are those of upper and lower limit 5P coins, respectively. Curves 503 and 504 are those of upper and lower limit 1 DM coins respectively. The vertical center line 505 indicates the point at which the center of the coin was passing the centers of the transmitting and receiving coils 120 and 140.

Figure 6:
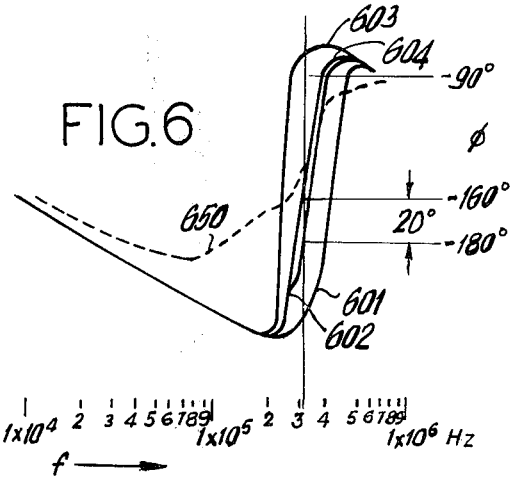
FIG. 6 is a plot of peak phase shift versus frequency of operation for apparatus similar to that of FIG. 2.

In order to maximize the discrimination between 5P and 1 DM coins, the inductor coils 120 and 140 of the apparatus 110 are arranged so that the receiving coil 140 detects both the field transmitted through the coin 115 and the field going around the coin 115. This makes the phase difference signal dependent upon the diameter of the coin, as well as its material characteristics and thickness. The frequency applied to the transmitting coil 120 is selected so that the amplitude of the field going around a coin 115 on the track 112 and centered at the examination position is a substantial fraction of the amplitude transmitted through the coin 115. FIG. 6 is a plot of the peak phase shift versus frequency for an apparatus such as the apparatus 110 of this embodiment. Lines 601 and 602 represent the upper and lower limits for 1 DM coins respectively, and lines 603 and 604 represent the upper and lower limits for 5P coins, respectively. FIG. 6 is illustrative of the substantial improvement in discrimination between 5P and 1 DM coins which can be obtained with such apparatus at frequencies between approximately 250 and 350 kHz. For example, at a frequency of 320 kHz, the phase separation between the typical lower limit 5P coins and the typical upper limit 1 DM coin was approximately 20°.

It should be noted, however, that depending on the core height above the coin track, other coins, such as a typical 50 pfennig (50 pf) coin indicated by line 650 in this case, may produce a phase shift within the range for acceptable 5P and 1 DM coins. For this reason, additional means are necessary for determining whether a coin is potentially a 5P or 1 DM coin, for example, a diameter characteristic examination means.

In another apparatus generally of the type discussed above with respect to FIG. 2, the transmitter coil 120 was made by winding 39 turns of 0.15 mm copper wire in four flat layers on the bobbin of a Cambion type 1181-8-3 ferrite core made by Cambridge Thermionic Corporation. The shield supplied with the core was not used. The receiver coil 140 was made by winding 198 turns of 0.07 mm wire in flat layers on the bobbin of the same type of core. The coil 140 was covered by a closed shield 142 of aluminum (other high conductivity material would also be satisfactory), having a hole 144 4mm in diameter in the center of the end 143 and a 1 mm wide slit from the hole 144 down the entire side of the shield to prevent it from being a shorted loop. The end 143 surface of the receiver shield 142 was substantially flush with the sidewall 116 of the coin passageway 111. The end of the receiver coil core 141 was recessed 4 mm from the sidewall 116. The end of the transmitter coil core was recessed 2 mm from sidewall 114. The coils 120 and 140 were concentric about a common axis 12 mm above the coin track 112. Sidewalls 114 and 116 were spaced 5 mm and canted 12° from vertical to cause coins to bear against sidewall 114. The apparatus was operated at a frequency of approximately 300 kHz. The proper choices of the spacing between the coin and the end 143 of the shield 142, which is dependent upon the spacing of the sidewalls 114 and 116, is apparently an important factor in optimizing the ability of this apparatus to discriminate between coins of denominations having similar physical characteristics. While the method and apparatus of these embodiments have been described primarily in the context of the difficult problem of distinguishing the 5P and 1 DM denomination coins, the method and apparatus also have significant utility in other coin discrimination systems. The frequency of operation, and size and location of coils may readily be determined by empirical methods for the particular acceptable coins expected in each case.

Figure 3:
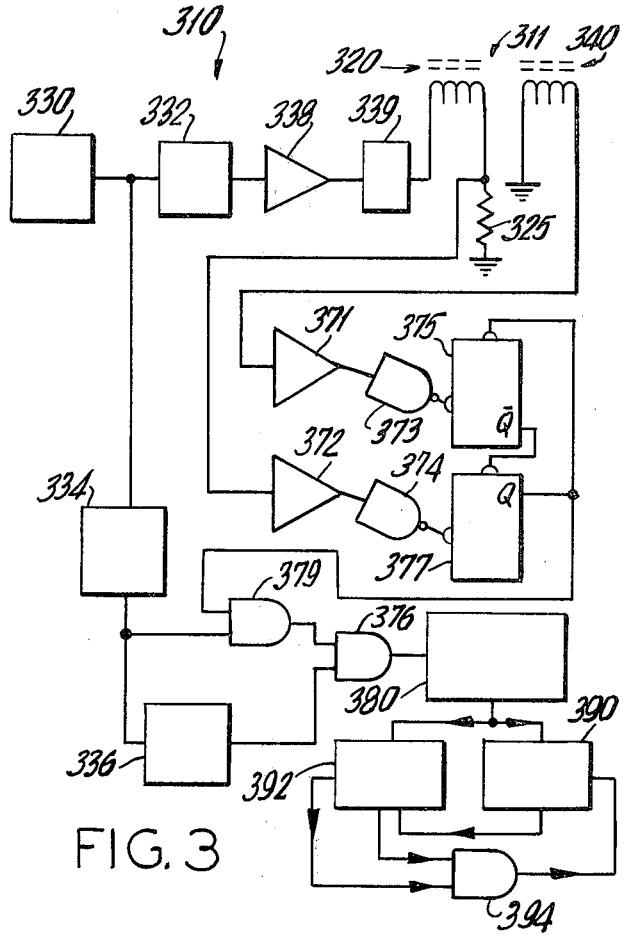
FIG. 3 is a schematic block diagram of apparatus for digitally comparing the phase of signals in coin discrimination apparatus.

FIG. 3 illustrates a means and method in a coin discriminator for digitally comparing the phase of a transmitted signal with the phase of the received signal. The basic technique is to produce a periodic pulse train whose duty cycle is proportional to phase shifts. The circuit of FIG. 3 produces a zero duty cycle pulse train for zero phase shift and a near 100% duty cycle pulse trains for a near 360° phase shift. This pulse train is used to gate high frequency pulses from a clock into a counter, resulting in a count proportional to pulse width.

In the specific apparatus 310 of FIG. 3, a transmitter inductor 320 and a receiver inductor 340 are positioned opposite each other on either side of a coin passageway 311.

According to this embodiment, the oscillator 330 produces a frequency substantially higher than the frequency used in examining coins in the apparatus 310, in this example an oscillator frequency of 23.5 MHz is used. A divider 332 divides the frequency received from the oscillator 320 by 256, producing a square wave frequency of 91.8 kHz for application to the transmitter coil 320 via an amplifier 338 and filter 339, which converts the square waveform into a sine wave.

Figure 4:
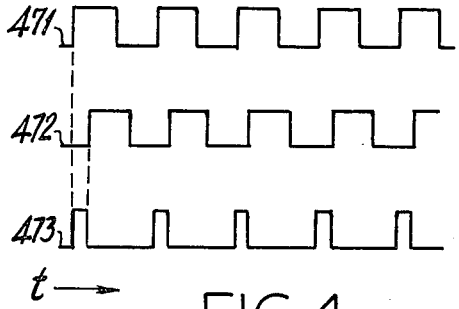
FIG. 4 is a waveform diagram relating to the apparatus of FIG. 3.

The voltage signal across resistor 325, representing the current through the transmitter coil 320, and the open circuit voltage signal across receiver coil 340 are each squared by wave shaping circuits comprising amplifiers 372 and 371 followed by inverting Schmitt triggers 374 and 373, respectively. These squared signals are then applied to the clock inputs of JK flipflops 375 and 377. The Q output of flipflop 375 is connected to the overriding reset of flipflop 377 and the Q output of flipflop 377 is connected to the overriding reset of flipflop 375. The signal from Schmitt trigger 373 always lags behind that from Schmitt trigger 374 by an amount dependent upon the difference between transmitted and received phase angles. The Q output of flipflop 377 is a pulse train having a duty cycle dependent upon this difference in phase angles. Typical waveforms 471 and 472 at the clock inputs of the flipflops 377 and 375, respectively, are shown in FIG. 4. Waveform 473 is the phase difference indicative waveform produced at the Q output of the flipflop 377 when input waveforms 471 and 472 are applied.

In order to provide improved accuracy, a number of pulse groups are fed to the counter 380 during each measurement period, in this case eleven groups. Since the clock pulses in each of these groups have a different phase relationship to the start of the group, whcih is dependent on the phase difference frequency, the counter 380 effectively integrates eleven samples. To ensure that the vast majority of the clock pulses counted by the counter 380 and the phase difference pulses produced by the flipflop 377 are not synchronized, the clock pulses are produced by divider 334, which divides down by 11 from the frequency of the oscillator 330, producing clock pulses at a frequency of 2.14 MHz. The clock pulses are in phase with the phase difference pulses every 256 clock pulses, which corresponds to every 11 phase difference pulses. This provides a measurement accuracy of 1 part in 256 or, in terms of phase error, 1.4 °.

The phase difference pulses from flipflop 377 and the clock pulses from divider 334 are applied to the inputs of an AND gate 374. The output of the AND gate 374 is a series of groups of clock pulses in which the number of pulses in each group is dependent upon the phase difference and the frequency of occurrence of the groups is the frequency applied to the transmitter inductor 320. The measurement period is defined by a divider 336 which divides the clock pulse rate by 512, producing a 4.17 kHz square wave signal which is applied to AND gate 376 gating eleven pulse groups into the counter 380 in a period of 119.9 microseconds. At the end of the measurement period, the contents of the counter 380 are compared with the contents of a memory 390 by comparator 392, and is transferred to the memory 390 via AND gate 394 if the comparison indicates that the count in counter 380 exceeds that in the memory 390. Counter 380 is then reset by housekeeping circuitry (not shown) before the next measurement period begins.

Figure 7:
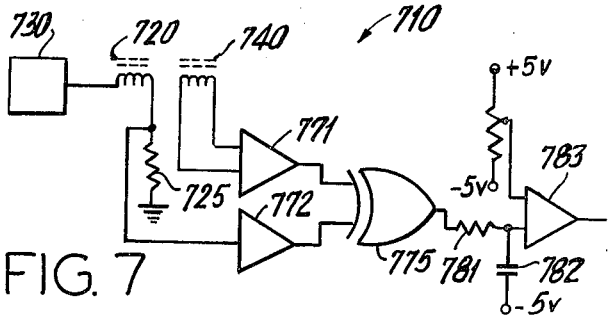
FIG. 7 is a schematic block diagram of a further embodiment of a similar coin discriminator.

Another apparatus 710, shown in FIG. 7 is a similar coin discriminator which differs from the apparatus of FIG. 3 primarily in that a frequency of 300 kHz is chosen, because it is within the optimum range for distinguishing the 1 DM and 5 P coins, and the phase shift between transmitted and received signals is converted into an analog system in which an amplitude is proportional to the phase angle difference. This analog signal is compared with a reference signal representing the lower limit (smallest phase angle difference) of the population of one of the coins to be distinguished. In this case of a 1 DM – 5P discriminator the largest phase shift is produced by the 1 DM population.

The oscillator 730 drives a transmitter inductor 720 and the phase of the transmitted signal is represented by the current through inductor 720 as measured by the voltage drop across resistor 725. The phase of this current and the voltage across receiver inductor 740 are each amplified and applied to wide band limiter amplifiers of the type used in television and FM radio receivers, then amplified again and shaped into square pulses by a pulse shaper, all of which functions are represented in FIG. 7 by amplifier circuitry 771 and 772 respectively. The outputs of these amplifiers are applied to an exclusive OR gate 775, whose output is a periodic pulse train with a duty cycle proportional to the phase angle difference. The use of an exclusive OR gate in this fashion produces a 100% duty cycle for a 180° phase shift. The pulse train is then integrated by an R-C filter having a time constant of 1 millisecond, comprising resistor 781 and capacitor 782. The voltage across capacitor 782 is continuously compared with the preset threshold voltage from adjustable resistor 784. Comparator 783 will then produce an output signal to indicate the presence of an acceptable 1 DM coin only when the phase difference is sufficiently large for the voltage across capacitor 782 to exceed the threshold voltage.

We claim:

1. A method for examining coins and identifying conductive coins of a particular denomination, comprising the steps of generating a high frequency signal, transmitting an electromagnetic field from a first inductor driven by the high frequency signal, receiving a portion of the field with a second inductor spaced from the first inductor, selecting the frequency and location of the inductors relative to the coin under examination so that the amplitude of the part of the field passing through the coin to the second inductor and the amplitude of the part of the field passing around the coin to the second inductor are approximately equal when the coin is a coin of the particular denomination, determining the phase difference between the signal in the first inductor and the signal in the second inductor, and comparing the value of the phase difference with predetermined limits for coins of the particular denomination.

2. The method of claim 1 wherein a small increase in frequency from the selected frequency of operation will cause the phase difference for a non-ferromagnetic conductive coin of the particular denomination to approach the phase difference occurring when no coin is present.

3. The method of claim 1 wherein an increase in thickness of a non-ferromagnetic conductive coin under examination from that of otherwise similar coins of the particular denomination will cause the phase difference to change towards the phase difference which occurs when no coin is under examination.

4. The method of claim 1 further comprising the steps of producing a first alternating current signal of a substantially higher frequency than that of the magnetic field, dividing the frequency of the first signal to produce a second signal of lower frequency, driving the magnetic field producing means with the second signal, dividing the frequency of the first signal to produce a third clock pulse signal of higher frequency than and substantially out of synchronization with the second signal, dividing the frequency of the first signal to produce a fourth timing signal of lower frequency than the first, second and third signals, producing a fifth signal representative of the detected field, producing a sixth signal having the same frequency as the second and fifth signals and a pulse width dependent on the difference in phase between the second and fifth signals and counting the pulses of the third signal coincident with pulses of the sixth signal throughout a period determined by the fourth signal.

5. The method of claim 1 wherein the phase difference is determined between the phase of the current in the first inductor and the phase of the voltage across the second inductor.

6. The method of claim 5 wherein a small percentage change in frequency while a non-ferromagnetic conductive coin of the particular denomination is under examination will cause a change in phase difference between −180° and −90°.

7. The method of claim 1 further including the steps of producing a first signal representative of the field on one side of the coin, producing a second signal representative of the detected field in the other side of the coin, and producing a third signal of the same frequency as the first and second signals, the duty cycle of which is representative of the phase difference between the first and second signals.

8. The method of claim 7 further including the steps of integrating the third signal and comparing the voltage of the integrated signal with a predetermined voltage standard to determine if the phase difference is within predetermined limits for acceptable coins of a given denomination.

9. The method of claim 1 further including the step of producing a signal if the difference between the phases is within predetermined limits for acceptable coins of a given denomination.

10. The method of claim 9 further comprising the steps of producing a first alternating current signal of a substantially higher frequency than that of the magnetic field, dividing the frequency of the first signal to produce a second signal of lower frequency, driving the magnetic field producing means with the second signal, dividing the frequency of the first signal to produce a third clock pulse signal of higher frequency than and substantially out of synchronization with the second signal, dividing the frequency of the first signal to produce a fourth timing signal of lower frequency than the first, second and third signals, producing a fifth signal representative of the detected field, producing a sixth signal having the same frequency as the second and fifth signals and a pulse width dependent on the difference in phase between the second and fifth signals and counting the pulses of the third signal coincident with pulses of the sixth signal throughout a period determined by the fourth signal.

11. The method of claim 9 further including the steps of producing a first signal representative of the field on one side of the coin, producing a second signal representative of the detected field in the other side of the coin, and producing a third signal of the same frequency as the first and second signals, the duty cycle of which is representative of the phase difference between the first and second signals.

12. The method of claim 11 further including the steps of integrating the third signal and comparing the voltage of the integrated signal with a predetermined voltage standard to determine if the phase difference is within predetermined limits for acceptable coins of a given denomination.

13. Apparatus for examining coins and identifying conductive coins of a particular denomination comprising magnetic field producing means including high frequency signal generating means and first inductor means for producing the magnetic field, the first inductor means being driven by the high frequency signal generating means, means for positioning a coin in a coin test position with one face in proximity to the first inductor, means for producing a first signal representative of the phase of the field on the first inductor side of the coin, second inductor means for producing a second signal representative of the phase of the field in proximity to the other face of the coin, and means for comparing the phase information of the first and second signals, wherein the frequency produced by the high frequency generating means and the location of the inductors relative to the coin test position are such that the amplitude of the part of the magnetic field which will pass through a coin of the particular denomination located in the coin test position to the second inductor and the amplitude of the part of the field which will pass around such a coin are approximately equal when the coin is a genuine coin of the particular denomination.

14. The apparatus of claim 13 wherein the means for comparing the phase information includes an exclusive OR circuit connected to receive the first and second signals.

15. The apparatus of claim 13 wherein the coin positioning means comprises a passageway between the inductors having a coin track and a canted sidewall arranged to cause acceptable coins which move through the passageway to pass between the inductors on a predetermined path.

16. The apparatus of claim 13 wherein the first signal is representative of the phase of the current passing through an inductor which is the source of the field and the second signal is representative of the phase of the output voltage of the means for producing a second signal.

17. The apparatus of claim 13 wherein the phase information comparing means includes means for squaring the first signal, means for squaring the second signal, switching means connected to receive the first and second squared signals for producing a pulse train having a duty cycle representative of the difference between the phase of the first and second signals, an integrating circuit arranged to integrate the phase difference pulse train, a voltage reference, and a voltage comparator connected to compare the output of the integrating circuit and the volage reference.

18. The apparatus of claim 17 wherein the switching means is an exclusive OR circuit.

19. The apparatus of claim 13 further including a shield of high conductivity material surrounding the principal detecting end and sides of the second inductor, the shield having a hole in the end to permit the magnetic field to reach the inductor from a limited region and a slit from the hole down one side of the shield to prevent the shield from being a shorted loop.

20. The apparatus of claim 19 wherein the inductor has a core and the shield hole is concentric with the inductor core.

21. The apparatus of claim 13 wherein the field producing means further comprises a first frequency divider arranged to reduce the oscillator frequency for application to the first inductor, further comprising switching means connected to receive the outputs of the first and second inductors for producing a pulse train having a duty cycle representative of the difference between the phase of the current through the first inductor and the phase of the voltage across the second inductor, a second frequency divider connected to divide the oscillator frequency for producing a clock pulse signal of higher frequency and substantially out of synchronization with the output of the first frequency divider, a third frequency divider connected to divide the oscillator frequency which produces a timing signal of lower frequency than the output of the first and second frequency dividers, a counter, and combinatorial means for gating the clock pulse signal to the counter during each pulse of the switching means output which occurs during one pulse of the timing signal.

22. The apparatus of claim 21 further comprising a register for storing the peak count by the counter, and a comparator to compare the content of the register with the content of the counter and transfer the content of the counter to the register when the comparison indicates that the counter content is larger than the register content.

23. The apparatus of claim 21 further comprising a register for storing the peak count by counter, and a comparator to compare the content of the register with the content of the counter and transfer the content of the counter to the register when the comparison indicates that the counter content is larger than the register content.

24. The apparatus of claim 23 further including a shield of high conductivity material surrounding the principal detecting end and sides of the second inductor, having a hole in the end to permit the magnetic field to reach the inductor from a limited region.

* * * * *

UNITED STATES PATENT AND TRADEMARK OFFICE

CERTIFICATE OF CORRECTION

PATENT NO. : 3,966,034

DATED : June 29, 1976

INVENTOR(S) : Fred P. Heiman & Guustaaf A. Schwippert

It is certified that error appears in the above-identified patent and that said Letters Patent are hereby corrected as shown below:

Col. 5, line 16, "whcih" should be --which--.

Col. 5, line 32, "374" should be --379-- (both occurrences).

Col. 5, line 45, "gate 394" should be --gate 379--.

Col. 8, line 47, Claim 17, "volage" should be --voltage--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*